US005324223A

United States Patent [19]

Yang

[11] Patent Number: 5,324,223

[45] Date of Patent: Jun. 28, 1994

[54] FLYING TOY

[76] Inventor: Tsung-Pin Yang, No. 12, Alley 2, Lane 131, Chang-Chin Rd. Hsi-Jyy, Taipai Tsien, Taiwan

[21] Appl. No.: 73,031

[22] Filed: Jun. 8, 1993

[51] Int. Cl.[5] ..... A63H 27/00

[52] U.S. Cl. ..... 446/46; D21/86

[58] Field of Search ..... 446/46, 47, 217; 273/424, 425; D21/85, 86

[56] References Cited

U.S. PATENT DOCUMENTS 3,089,269 5/1963 McKiernan ..... 446/121 X 4,031,656 6/1977 Kupperman et al. ..... 446/217

4,077,155 3/1978 Bruntmyer ..... 446/46

4,515,570 5/1985 Beltran ..... 446/47

5,055,080 10/1991 Cwalinski et al. ..... 446/46

*Primary Examiner*—Mickey Yu

*Attorney, Agent, or Firm*—Morton J. Rosenberg; David I. Klein

[57] ABSTRACT

A flying toy is provided having a flying disk, and a model aircraft pivotally coupled to the flying disk by a flanged, split bottom pin. The pin is inserted into a central through hole formed in the top of the flying disk.

1 Claim, 3 Drawing Sheets

FLYING TOY

BACKGROUND OF THE INVENTION

The present invention relates to a flying toy, and more particularly to such a flying toy which couples a model aircraft to a flying disk at the top.

Various flying disks have been disclosed in the prior art, and have appeared on the market for use by throwing them, so that they fly through the air. These flying disks are simple in structure, but not very attractive.

The present invention provides a flying toy which is totally new. A flying toy in accordance with the present invention is comprised of a model aircraft coupled to the top of a flying disk. The model aircraft is fastened to the flying disk by inserting a flanged, split pin into a center through hole on the flying disk. Further, the model aircraft has a propeller, two symmetrical wings, and a rudder. Therefore, the model aircraft can navigate itself to help the flying disk float in the air as the flying disk is sent flying through the air.

DETAILED DESCRIPTION OF THE PREFERRED EMBODIMENT

Figure 1:
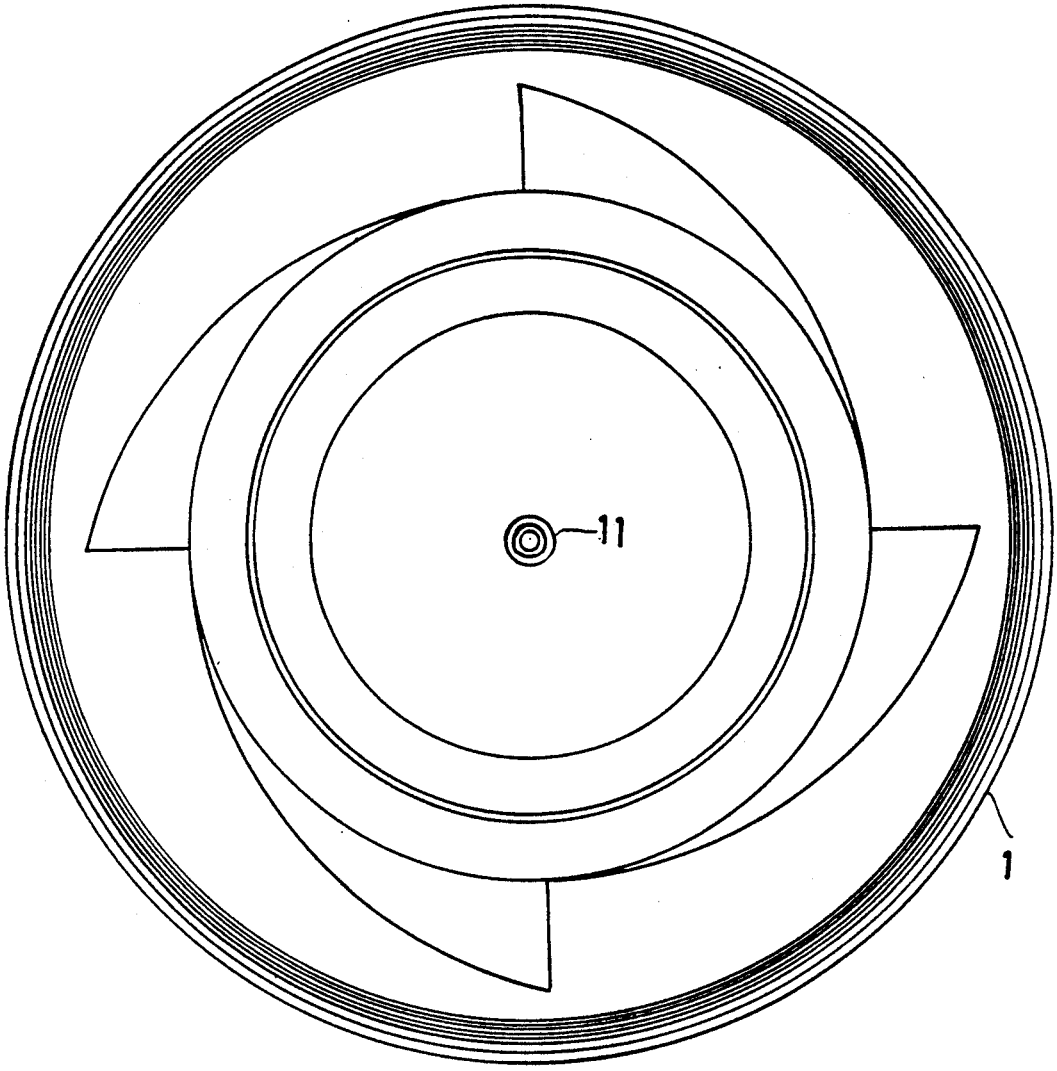
FIG. 1 is a top view of a flying disk according to the present invention.
Figure 2:
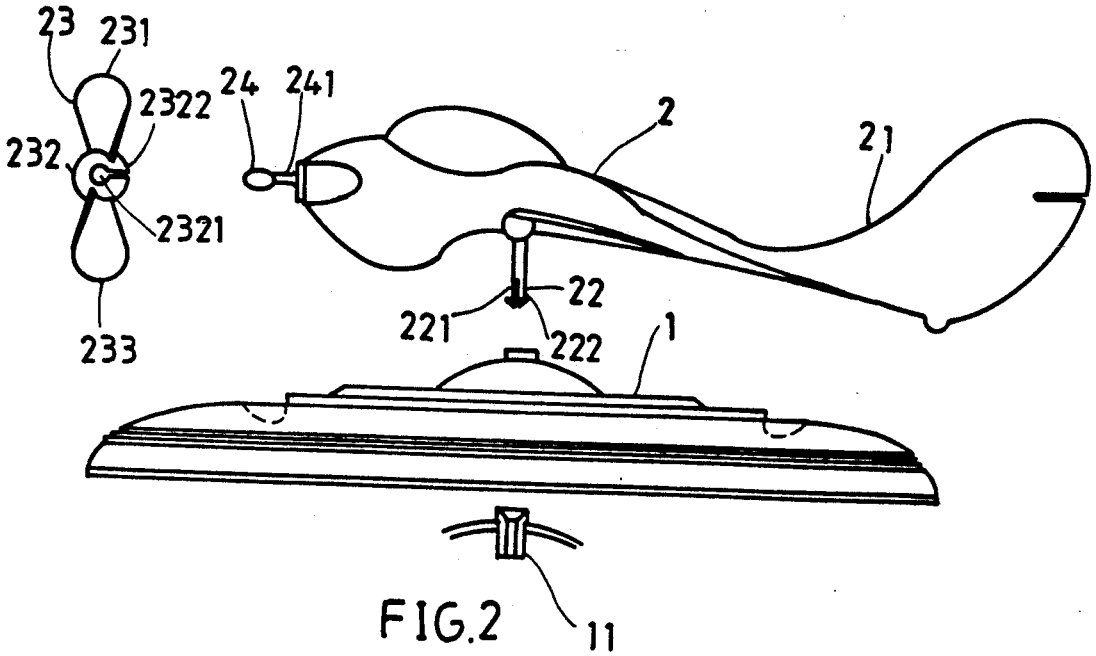
FIG. 2 is an exploded view of a flying toy according to the preferred embodiment of the present invention.
Figure 3:
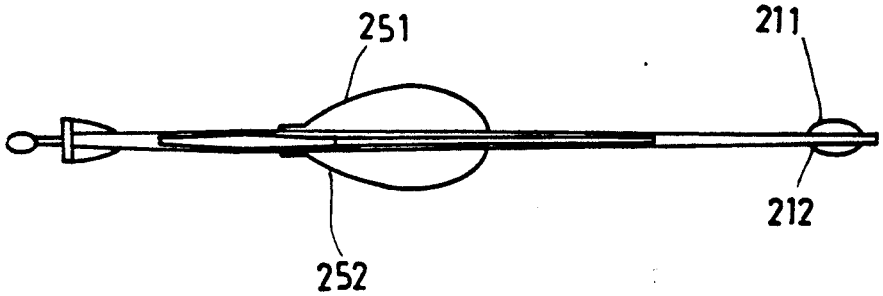
FIG. 3 is a top view of the flying toy of the preferred embodiment of the present invention.
Figure 4:
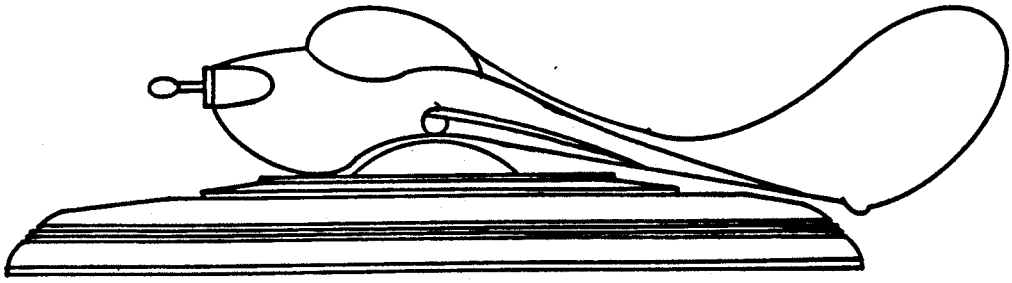
FIG. 4 is a front view of the flying toy of the preferred embodiment of the present invention.

Referring to FIGS. 2, 3 and 4, a flying toy in accordance with the present invention is generally comprised of a flying disk 1 and a model aircraft 2 mounted on the flying disk 1. The flying disk 1 has a centrally disposed through hole 11 at the top for mounting the model aircraft 2. The model aircraft 2 has a split pin 22 at the bottom. The split pin 22 is dimensioned in correspondence with the inner diameter of the central through hole 11 on the flying disk 1, wherein the bottom ends, terminated with the hooked portions 221 and 222, pass through hole 11 when pressed together. Once the split pin 22 is inserted through the through hole 11, the hooked portions 221 and 222 immediately spring apart and engage the bottom edge of the flying disk 1 at the perimeter of through hole 11. Therefore, the model aircraft 2 does not disconnect from the flying disk 1 and can be rotated thereon.

The model aircraft 2 comprises a short horizontal rod 241 terminated in a head 24 for mounting a propeller 23 thereon. The propeller 23 comprises two oppositely twisted blades 231 and 233, symmetrically connected to a C-shaped hub 232. The C-shaped hub 232 has a mounting hole 2321 formed therethrough, and a spring catch 2322. By opening the spring catch 2322, the short horizontal rod 241 can be engaged into the mounting hole 231 for allowing the propeller 23 to be rotatably retained to the short horizontal rod 241. When fastened, the head 24 stops the C-shaped hub 23 from sliding off rod 241. The model aircraft 2 further comprises two wings 251 and 252 disposed on opposing sides of a fuselage, and a rudder 21 at the tail of the fuselage with two horizontal stabilizers 211 and 212 extending from opposing sides thereof, wherein the wings 251 and 252 keep the combined flying disk aircraft 1 and 2 in balance and increase the ability of the combined flying disk 1 and model aircraft 2 to float through the air. The rudder 21 is provided for steering control, and the horizontal stabilizers 211 and 212 stabilize the flying of the combined flying disk and model aircraft 2 in the air.

Before playing with the flying toy, the model aircraft 2 must be fastened to the flying disk 1. When in play, the flying disk 1 is sent flying from the hand. While the flying disk 1 is flying through the air, the model aircraft 2 will orient itself and maintain an alignment in the direction of travel of the flying disk 1. Therefore, the model aircraft 2 does not hinder the flying of the flying disk 1 through the air. When the flying toy is caused to fly through the air, the propeller 23 is rotated by air to propel the flying through the air. The operation of the propeller 23 can also help the flying toy fly stably.

Figure 5:
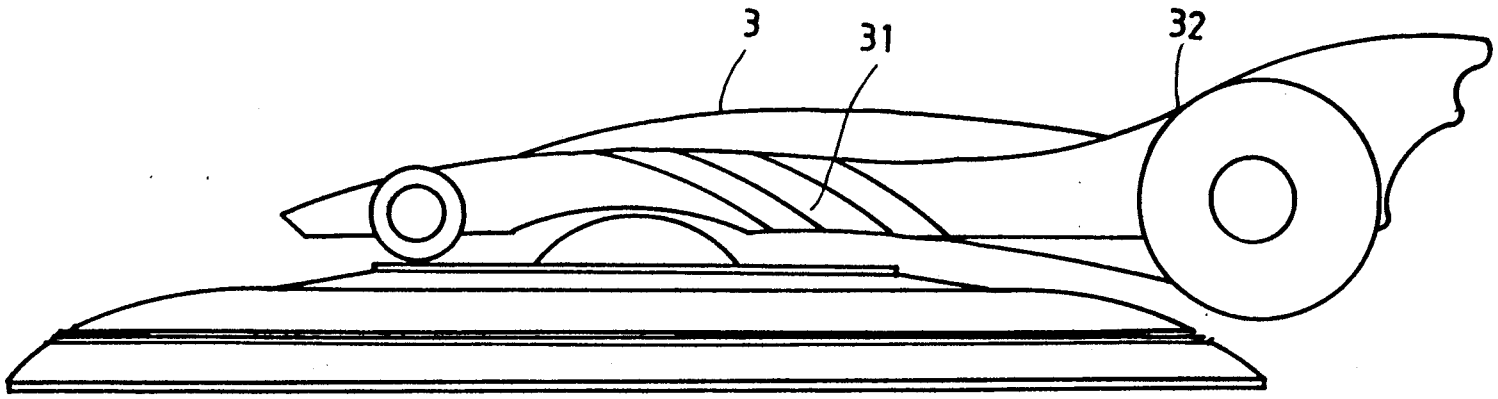
FIG. 5 illustrates an alternate form of the flying toy according to the present invention.

Referring to FIG. 5, there is illustrated an alternate form of the present invention. In this alternate form, the model aircraft 3 also has wings 31 and a rudder 32.

While only one embodiment of the present invention has been shown and described, it will be understood that various modifications and changes could be made without departing from the scope of the present invention.

What is claimed is:

1. A flying toy having an overall aerodynamic lift, comprising:

a flying disk having a centrally disposed opening formed therethrough, said flying disk having a first aerodynamic lift defined by an overall contour thereof; and aircraft means pivotally coupled to said flying disk for increasing said overall aerodynamic lift, said model aircraft means including (1) a longitudinally extended fuselage, (2) a propeller member rotatably coupled to a nose portion of said fuselage, (3) a pair of wing members extending from opposing sides of said fuselage, said pair of wings defining a second aerodynamic lift, (4) a rudder formed at a tail portion of said fuselage, (5) a pair of horizontal stabilizers extending from opposing sides of said rudder, and (6) a pin member extending from a lower portion of said fuselage transverse said longitudinal direction for pivotally engaging said flying disk through said centrally disposed opening, whereby said overall aerodynamic lift is defined by a summation of said first aerodynamic lift of said flying disk and said second aerodynamic lift of said pair of wing members.

* * * * *